US008739437B2

(12) United States Patent
Ropog et al.

(10) Patent No.: US 8,739,437 B2
(45) Date of Patent: Jun. 3, 2014

(54) SNOWPLOW BLADE

(75) Inventors: Jim Ropog, North Olmsted, OH (US); Marty Warchola, Medina, OH (US)

(73) Assignee: Meyer Products, LLC, Cleveland, OH (US)

( * ) Notice: Subject to any disclaimer, the term of this patent is extended or adjusted under 35 U.S.C. 154(b) by 405 days.

(21) Appl. No.: 13/116,065

(22) Filed: May 26, 2011

(65) Prior Publication Data

US 2012/0222334 A1 Sep. 6, 2012

Related U.S. Application Data

(60) Provisional application No. 61/449,498, filed on Mar. 4, 2011.

(51) Int. Cl.
*E01H 5/06* (2006.01)

(52) U.S. Cl.
USPC ..... 37/266; 37/264

(58) Field of Classification Search
USPC ..... 37/264, 266, 267, 272, 276, 281; D15/11
See application file for complete search history.

(56) References Cited

U.S. PATENT DOCUMENTS

| | | | | |
|---|---|---|---|---|
| D34,855 | S * | 7/1901 | Skinner | D15/11 |
| 1,926,011 | A | 9/1933 | Soule | |
| 2,231,875 | A * | 2/1941 | Behnke et al. | 37/231 |
| 2,642,294 | A * | 6/1953 | Holm | 280/460.1 |
| 2,904,904 | A | 9/1959 | Krueger | |
| 4,559,769 | A | 12/1985 | Seyerle | |
| 4,731,942 | A | 3/1988 | Eberle | |
| 4,833,801 | A | 5/1989 | Winter | |
| 4,837,951 | A | 6/1989 | Verseef | |
| 5,018,284 | A | 5/1991 | Mikami et al. | |
| D328,553 | S * | 8/1992 | Norton et al. | D8/10 |
| 5,477,600 | A * | 12/1995 | Houle et al. | 37/279 |
| 5,513,453 | A | 5/1996 | Norton | |
| 5,638,617 | A | 6/1997 | Belanger et al. | |
| 6,751,894 | B2 | 6/2004 | Verseef | |
| 6,938,701 | B2 * | 9/2005 | Matsumoto et al. | 172/811 |
| 7,100,311 | B2 | 9/2006 | Verseef | |
| 7,654,336 | B2 * | 2/2010 | Matsumoto et al. | 172/811 |
| 7,721,471 | B2 * | 5/2010 | Gamble, II | 37/275 |
| 2008/0314607 | A1 * | 12/2008 | May | 172/701.3 |

FOREIGN PATENT DOCUMENTS

EP 254570 A2 * 1/1988

* cited by examiner

*Primary Examiner* — Jamie L McGowan
(74) *Attorney, Agent, or Firm* — Roger D. Emerson; Timothy D. Bennett; Emerson, Thomson, Bennett

(57) ABSTRACT

By controlling the dimensions of a snowplow blade, improved snowplow performance may be achieved. In one embodiment, the snow that is being plowed moves both upward and outward from the mid-section of the snowplow blade toward and beyond each end of the snowplow blade.

20 Claims, 10 Drawing Sheets

SNOWPLOW BLADE

This application claims priority to U.S. Provisional Patent Application Ser. No. 61/449,498, entitled SNOWPLOW HAVING BOWTIE CONFIGURATION, filed Mar. 4, 2011, which is incorporated herein by reference.

I. BACKGROUND

A. Field of Invention

This invention pertains to the art of methods and apparatuses for snowplows and more specifically to methods and apparatuses for a snowplow blade.

B. Description of the Related Art

It is well known to provide snowplows for use in moving snow and ice from roads, driveways, parking lots and other such surfaces. Typically, the snowplow is suitable to be attached to a particular vehicle, such as a pickup truck or an All Terrain Vehicle (ATV). When the vehicle is moved, the snowplow blade contacts and plows the snow.

It is also known to provide snowplow blades with various shapes. However, it is desirable to have a snowplow blade having a unique shape that provides improved performance over known snowplow blades.

II. SUMMARY

According to one embodiment of this invention, a snowplow comprises a snowplow blade that is suitable to be attached to an associated vehicle and that has a snowplow surface for use in contacting and plowing associated snow as the associated vehicle moves. The snowplow surface may have: a bottom portion with a width W1; and, a top portion with a width W2 that is significantly greater than width W1. The snowplow surface may also have: a first end with a height H1; a second end with a height H2; and, a mid-section with a height H3 that is significantly less than height H1 and height H2. A horizontal line that extends from the first end to the second end between the bottom portion and the top portion of the snowplow blade may continuously contact the snowplow surface.

According to another embodiment of this invention, a snowplow comprises a snowplow blade that is suitable to be attached to an associated vehicle and that has a snowplow surface for use in contacting and plowing associated snow as the associated vehicle moves. The snowplow surface may have: a bottom portion; a top portion; and, a C-shaped cross-section. The snowplow surface may also have: a first end; a second end; and, a mid-section. The top portion of the first end may have at least a first segment that extends forwardly a first amount E1; the top portion of the second end may have at least a first segment that extends forwardly a second amount E2; and, the top portion of the mid-section may extend forwardly a maximum third amount E3 that is significantly less than the first and second amounts E1 and E2.

According to yet another embodiment of this invention, a snowplow comprises: a snowplow support frame that is suitable to be attached an associated vehicle; and, a snowplow blade that is suitable to be attached to the snowplow support frame and that has a snowplow surface for use in contacting and plowing associated snow as the associated vehicle moves. The snowplow surface may have: a bottom portion with a width W1; a top portion with a width W2 that is significantly greater than width W1; and, a C-shaped cross-section. The snowplow surface may also have: a first end with a height H1; a second end with a height H2; and, a mid-section with a height H3 that is significantly less than height H1 and height H2. A horizontal line that extends from the first end to the second end of the snowplow blade between the bottom portion and the top portion may continuously contact the snowplow surface. The top portion of the first end may have at least a first segment that extends forwardly a first amount E1; the top portion of the second end may have at least a first segment that extends forwardly a second amount E2; and, the top portion of the mid-section may extend forwardly a maximum third amount E3 that is significantly less than the first and second amounts E1 and E2.

Many benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
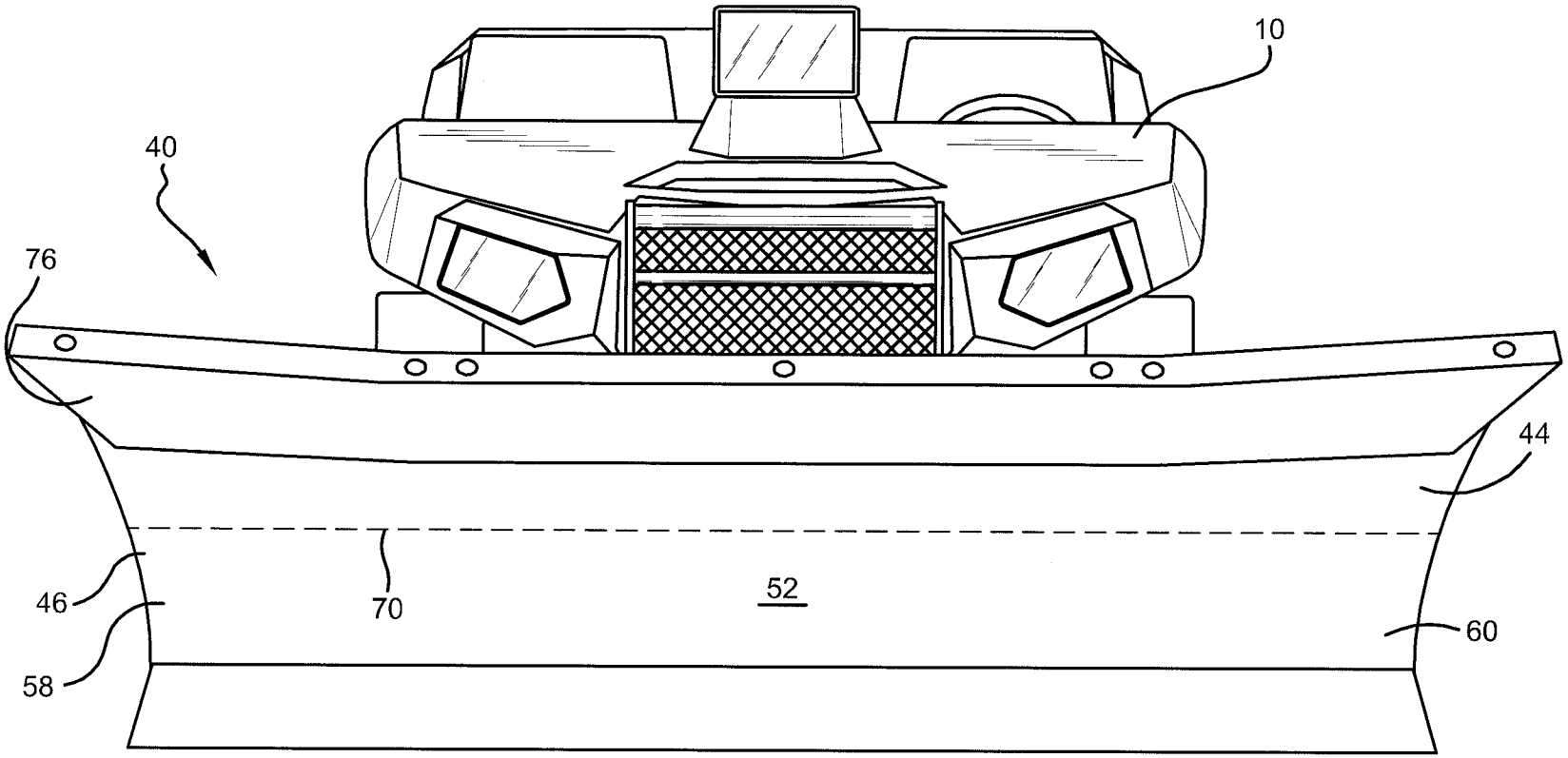
FIG. 1 is a front view of a snowplow attached to a vehicle.
Figure 2:
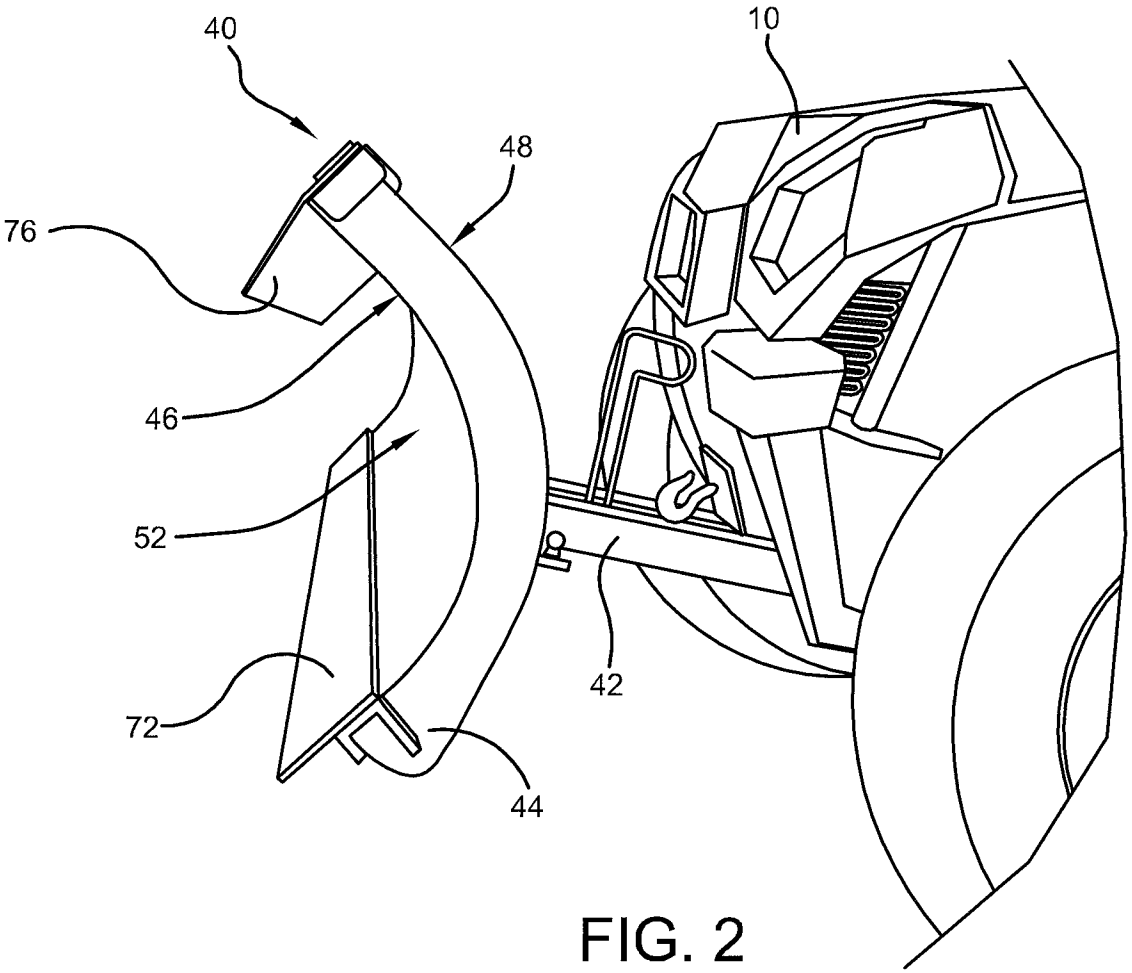
FIG. 2 is a perspective end view of the snowplow shown in FIG. 1.
Figure 3:
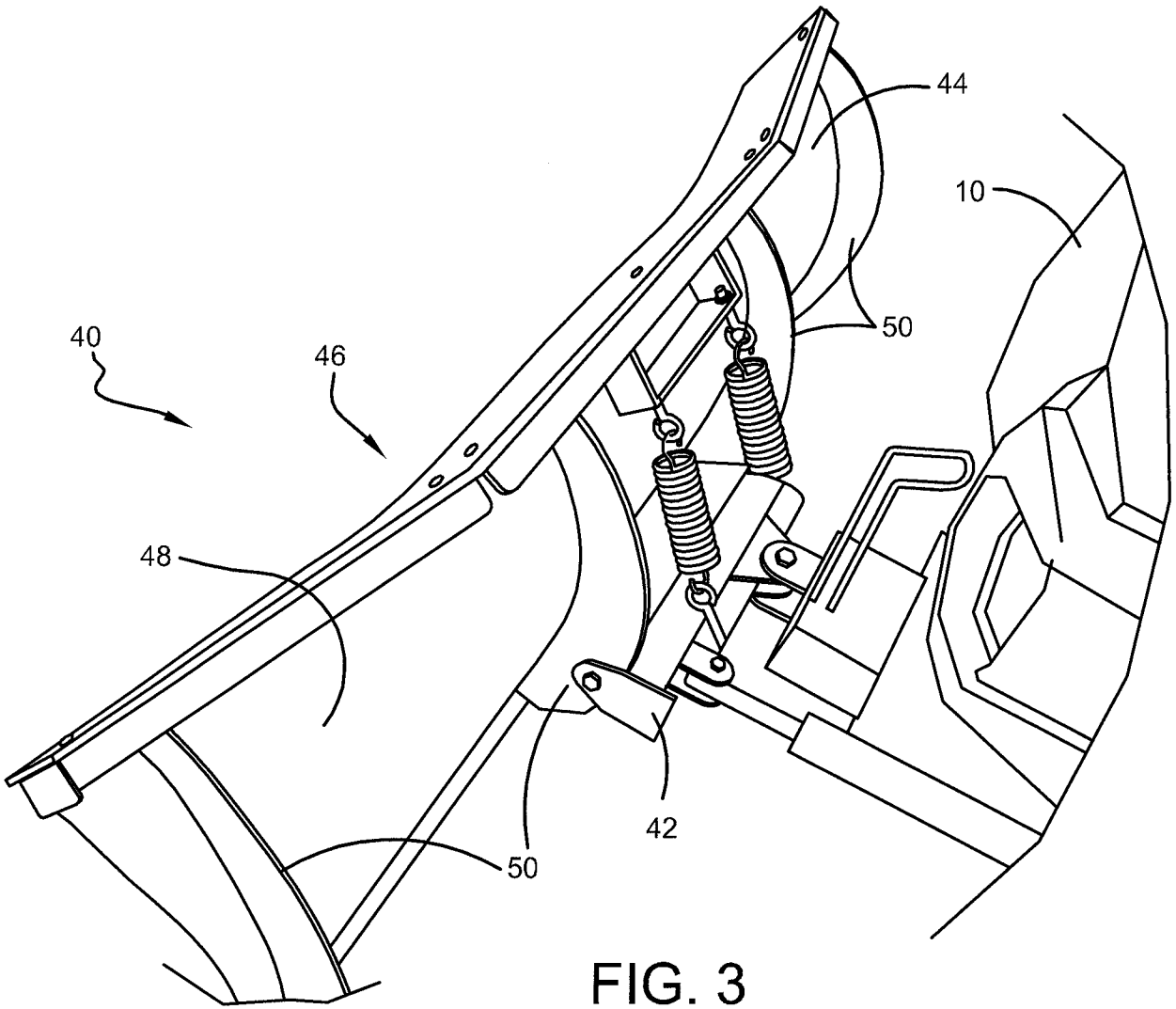
FIG. 3 is a perspective back view of the snowplow shown in FIG. 1.
Figure 4:
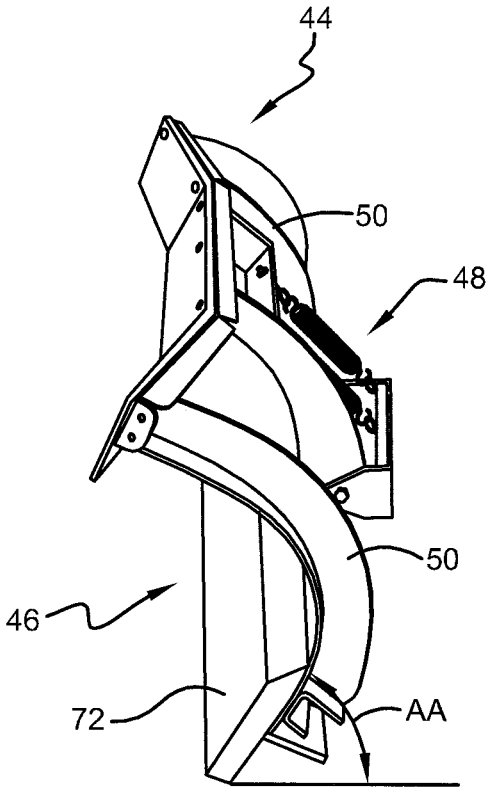
FIG. 4 is a perspective end view of a snowplow blade.

Referring now to the drawings wherein the showings are for purposes of illustrating embodiments of the invention only and not for purposes of limiting the same, and wherein like reference numerals are understood to refer to like components, FIGS. 1-3 show a vehicle 10 equipped with a snowplow 40 according to one embodiment of this invention. While the vehicle shown is an All Terrain Vehicle (ATV), it should be understood that the snowplow 40 of this invention will work well with any vehicle chosen with the sound judgment of a person of skill in the art. The snowplow 40 may include a snowplow support frame 42 and a snowplow blade or moldboard 44. The snowplow blade 44 is attached to the snowplow support frame 42 and the snowplow support frame 42 is used to attach the snowplow blade 44 to the vehicle 10. Both of these attachments may be made in any manner chosen with the sound judgment of a person of skill in the art.

With reference now to FIGS. 1-7, the snowplow blade 44 may have plow side 46 and a non-plow side 48. For the embodiment shown, the non-plow side 48 is attached to the snowplow support frame 42 and includes ribs 50 to improve the structural rigidity of the snowplow blade 44. The plow side 46 of the snowplow blade 44 may have a snowplow surface 52 for use in contacting and plowing snow as the vehicle 10 moves. The snowplow surface may include a cutting edge 72 and a deflector 76 may be attached to the top of the snowplow blade 44. As the operation of a snowplow blade is well known to those of skill in the art, details will not be provided here except as discussed below. The snowplow blade 44 may be formed of any material and in any manner chosen with the sound judgment of a person of skill in the art.

Figure 5:
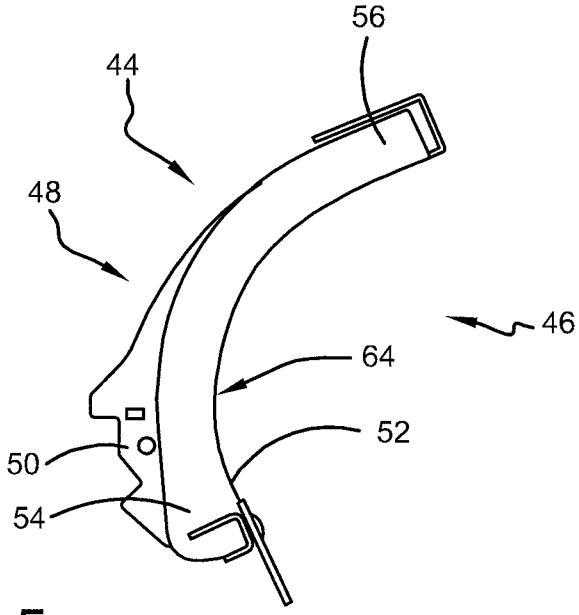
FIG. 5 is an end view of a snowplow blade.
Figure 6:
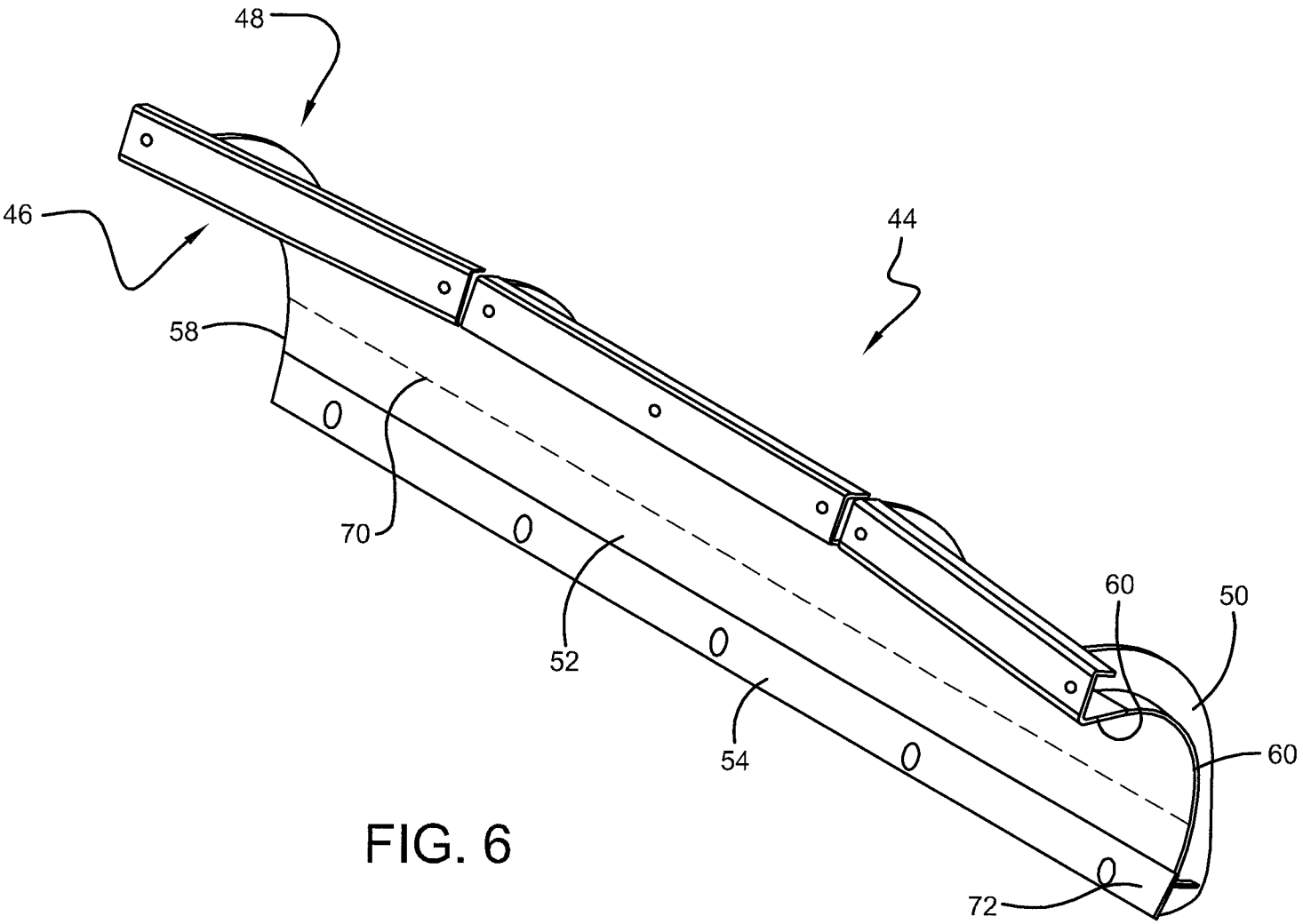
FIG. 6 is a perspective front view of a snowplow blade.
Figure 7:
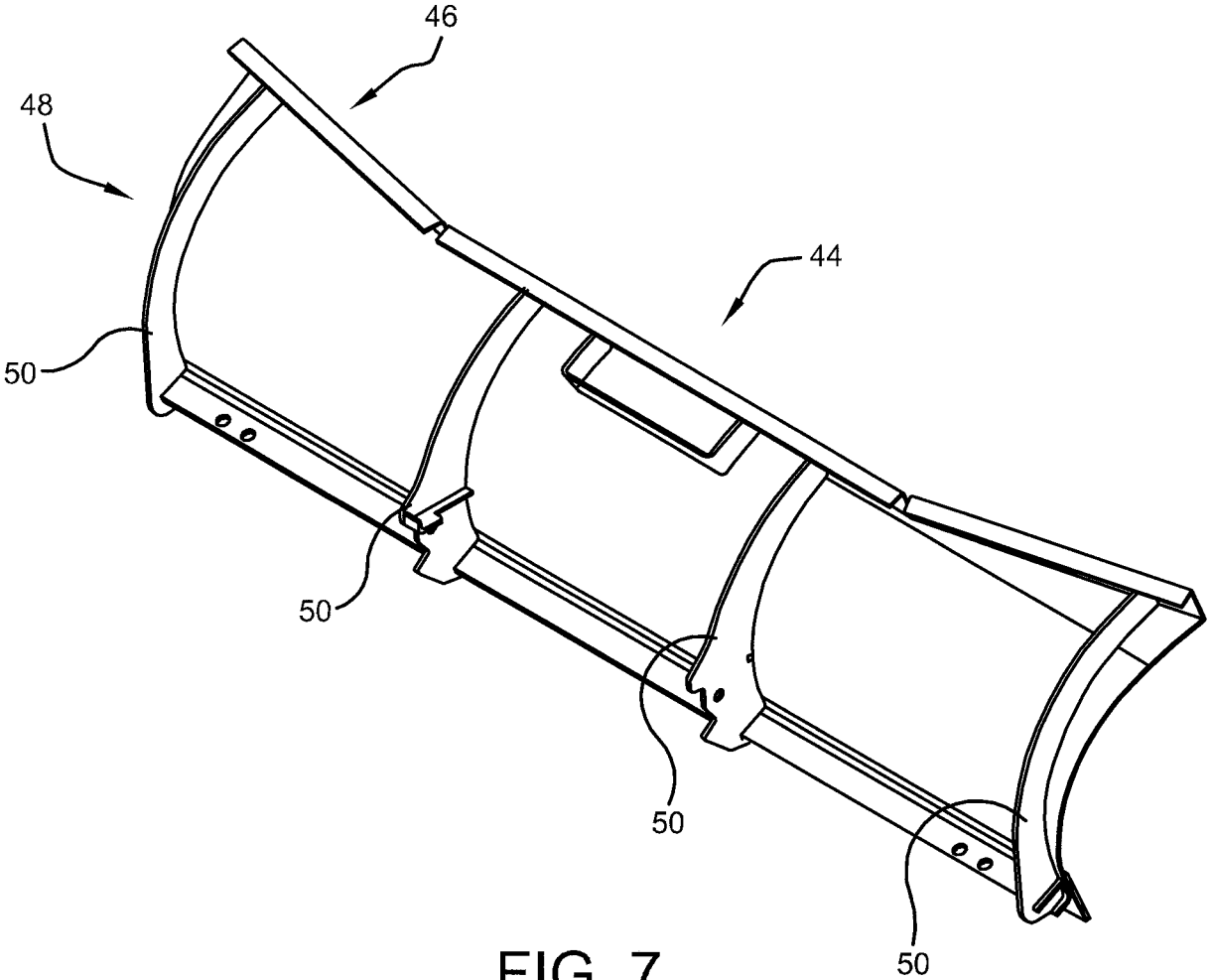
FIG. 7 is a perspective back view of the snowplow blade shown in FIG. 6.
Figure 8:
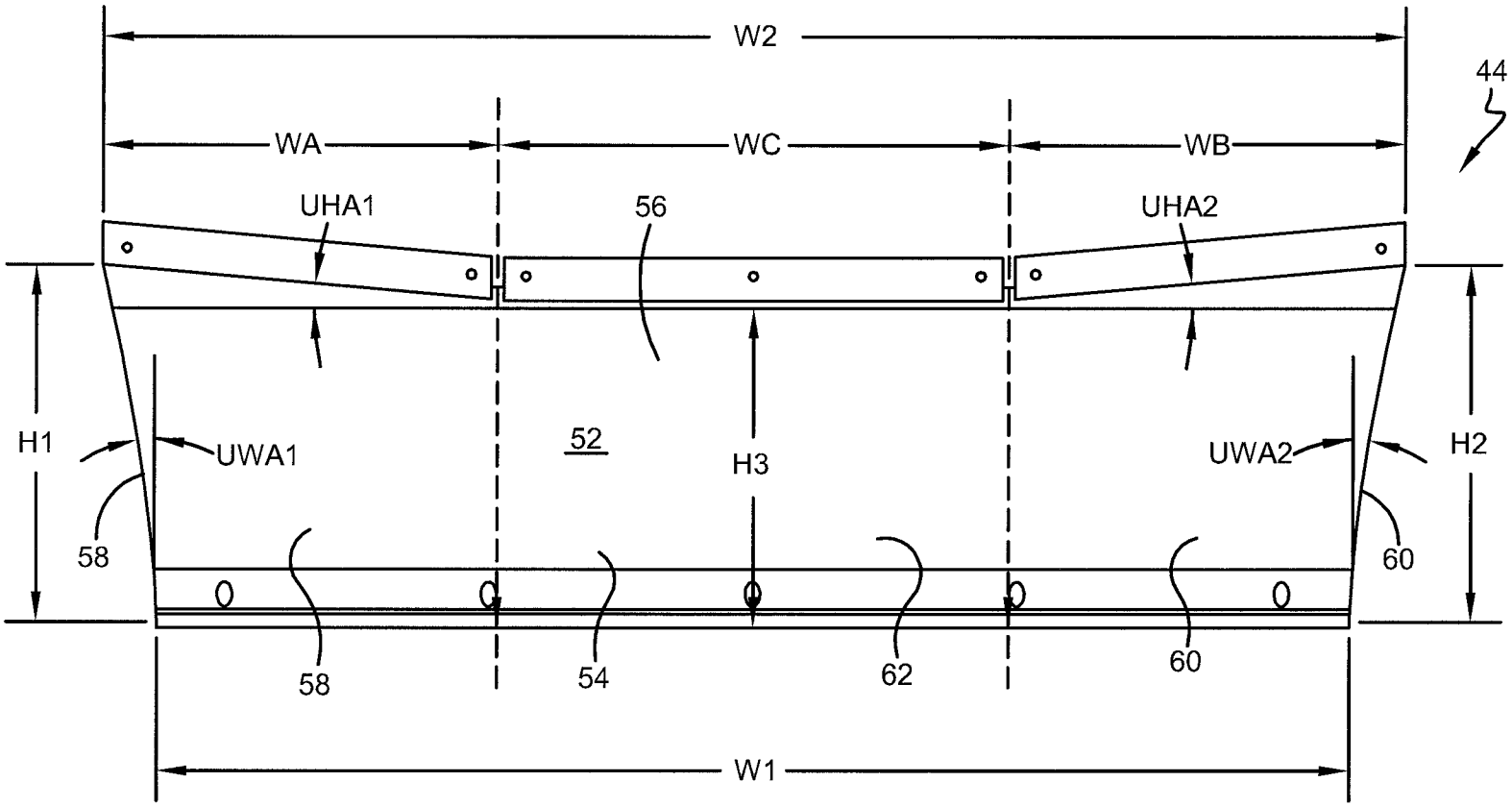
FIG. 8 is a front view of a snowplow blade.
Figure 10:
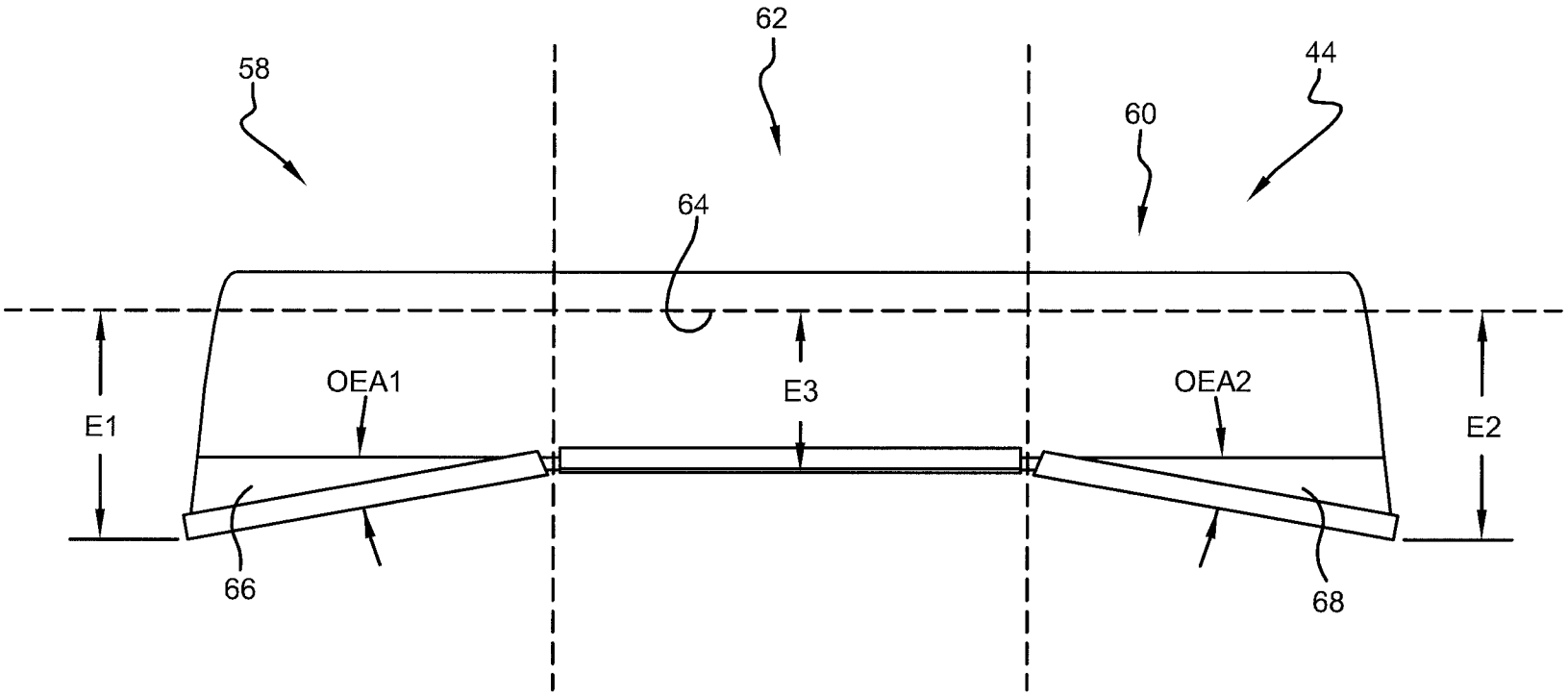
FIG. 10 is a top view of the snowplow blade shown in FIG. 8.

With reference now to FIG. 8, to help in describing the various embodiments for this invention, the following generic dimensions may be noted. The snowplow surface 52 may have a bottom portion 54 with a width W1 and a top portion 56 with a width W2. The snowplow surface 52 may also have a first end 58 with a height H1 and a width WA; a second end 60 with a height H2 and a width WB; and, a mid-section 62 with a height H3 and a width WC. In some embodiments, seen best in FIGS. 2 and 4-5, the snowplow blade 44 and the snowplow surface 52 is C-shaped. When the snowplow surface 52 is C-shaped, it has, as shown in FIGS. 5 and 10, a most internal location 64 of the convex shape. To achieve the C-shape, both the top and bottom portions 56, 54 extend forwardly from the internal location 64. As shown in FIG. 10, the top portion of the first end 58 may have at least a first segment 66 that extends forwardly a first amount E1; the top portion of the second end 60 may have at least a first segment 68 that extends forwardly a second amount E2; and, the top portion of the mid-section 62 may extend forwardly a maximum third amount E3.

Figure 11:
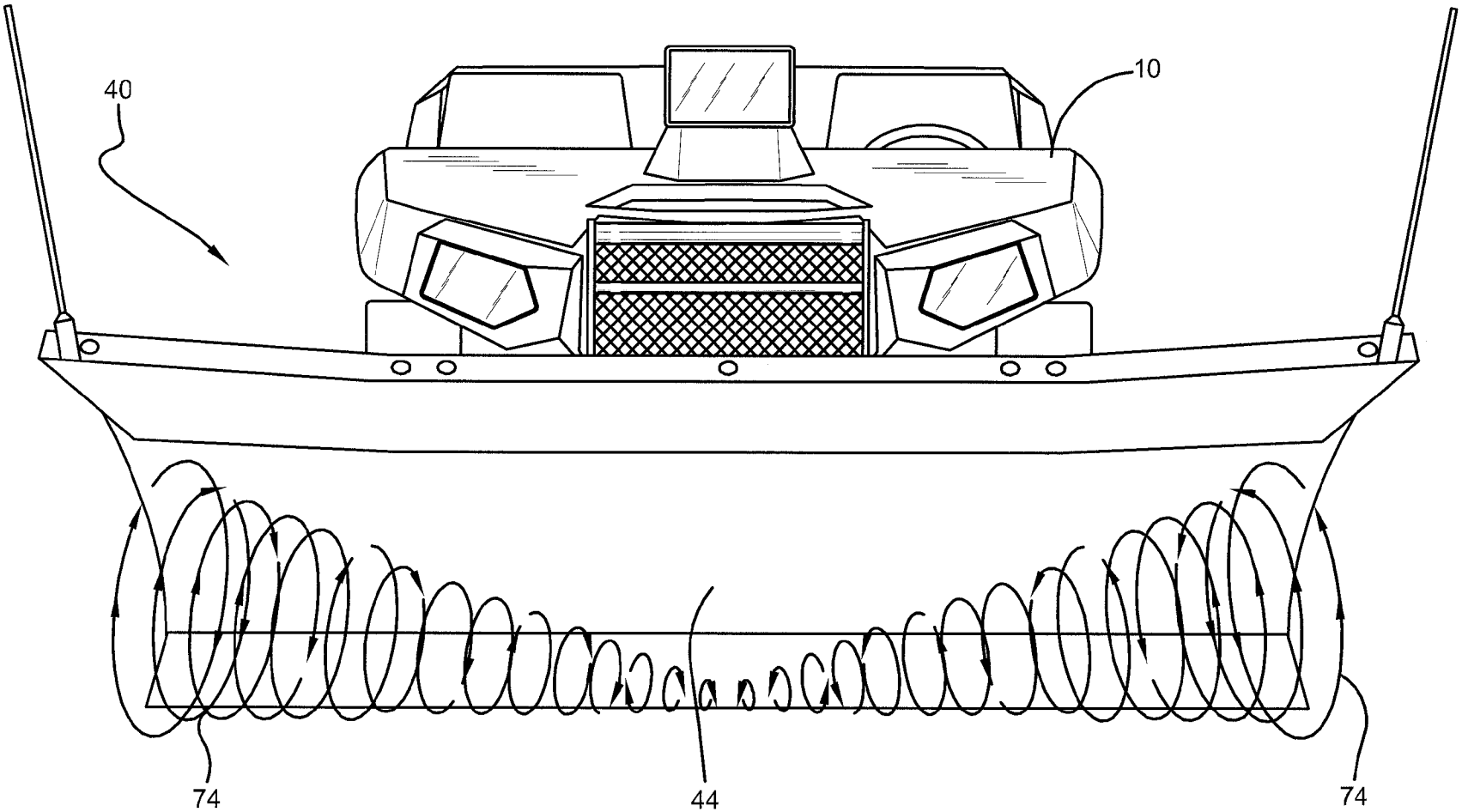
FIG. 11 is a front view of a snowplow attached to a vehicle.

With reference now to FIGS. 1-8, it has been discovered that by controlling these dimensions improved snowplow performance may be achieved. More specifically, it has been discovered that this invention provides for an optimum "funnel action" whereby the snow that is being plowed moves both upward and outward from the mid-section 62 toward and beyond each end 58, 60 of the snowplow blade 44. This funnel action 74, illustrated in FIG. 11, provides for the discharge of snow faster and more efficiently than previously know.

Figure 9:
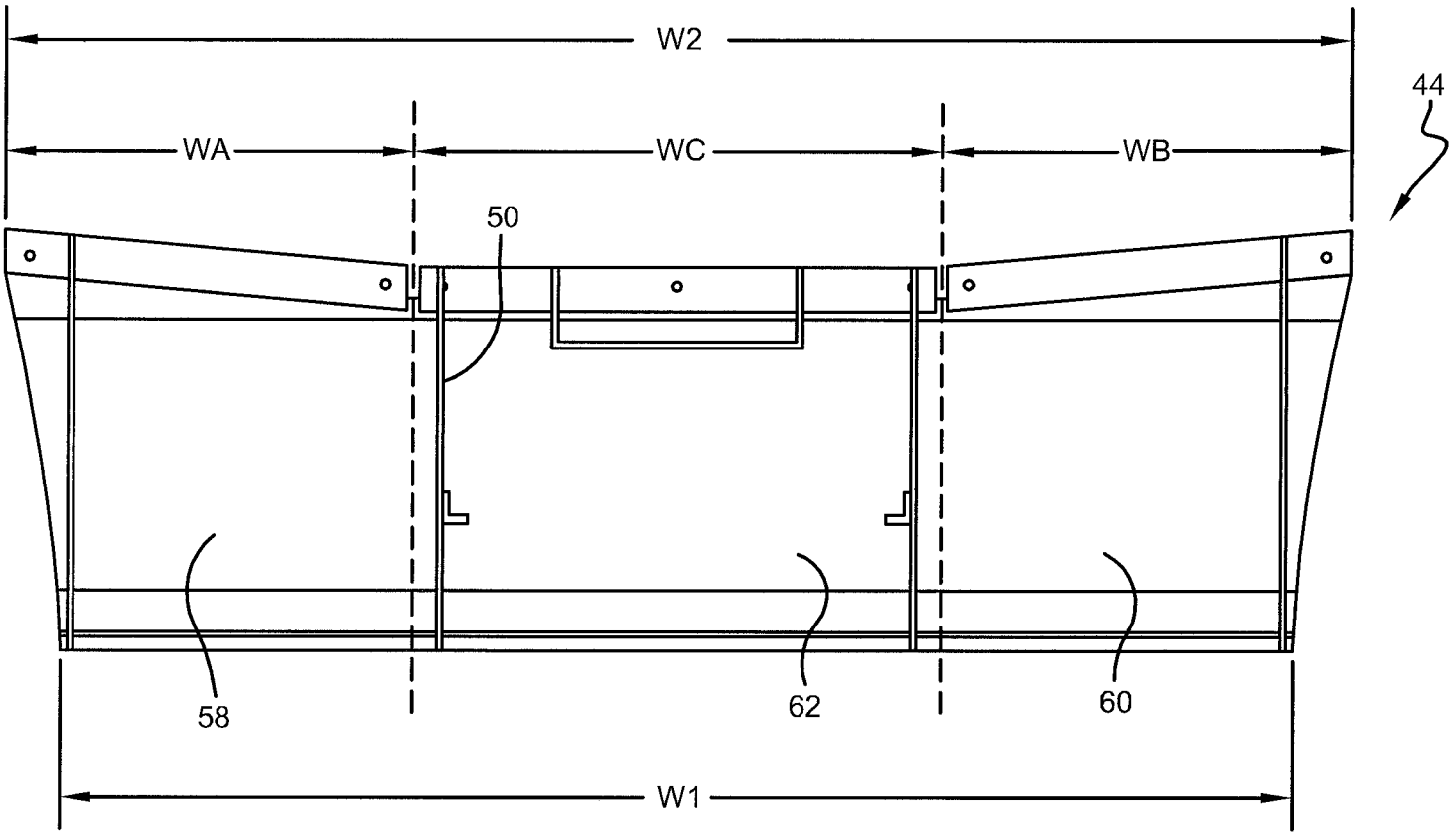
FIG. 9 is a back view of the snowplow blade shown in FIG. 8.

With reference now to FIGS. 8-9, in one embodiment, the width W2 of the top portion 56 is significantly greater than the width W1 of the bottom portion 54. In one specific embodiment, the ratio of the width W1 to the width W2 (W1/W2) is between 0.65 and 0.95 inclusively, in another W1/W2 is between 0.75 and 0.95 inclusively and, in another W1/W2 is between 0.85 and 0.95 inclusively. In another embodiment, the width of the snowplow surface 52 gradually increases from the bottom portion 54 with the width W1 to the top portion 56 with the width W2. In one specific embodiment, the first end 58 has an upward width angle UWA1 of between 5 degrees and 35 degrees inclusively, in another UWA1 is between 5 degrees and 25 degrees inclusively and, in another UWA1 is between 5 degrees and 15 degrees inclusively. Similarly, in one specific embodiment the second end 60 has an upward width angle UWA2 of between 5 degrees and 35 degrees inclusively, in another UWA2 is between 5 degrees and 25 degrees inclusively and, in another UWA2 is between 5 degrees and 15 degrees inclusively. It is contemplated to provide each end 58, 60 with the same width design (both with a UWA of between 5 degrees and 25 degrees, for one non-limiting example). It is also contemplated, however, for each end to have a different width design (one end may have a UWA of between 5 degrees and 35 degrees while the other end has a UWA of between 5 degrees and 15 degrees, for another non-limiting example). The widths WA, WB and WC of the first end 58, second end 60 and mid-section 62 can be any chosen with the sound judgment of a person of skill in the art. In one embodiment, the ratio of the width of the mid-section WB to the width W2 (WB/W2) of the top portion 56 is between 0.24 and 0.60, inclusively. In another embodiment, WB/W2 is between 0.40 and 0.50.

With continuing reference to FIGS. 8-9, in one embodiment, the height H3 of the mid-section 62 is significantly less than heights H1, H2 of the first and second ends 58, 60, respectively. The heights H1 and H2 may be the same, as shown, or in another embodiment the heights H1, H2 may be different from each other. In yet another embodiment, the height of the first end 58 of the snowplow surface 52 gradually increases outwardly from the height H3 to the height H1, as shown, and/or the height of the second end 60 of the snowplow surface 52 gradually increases outwardly from the height H3 to the height H2, as shown. In one specific embodiment, the first end 58 has an upward height angle UHA1 of between 3 degrees and 35 degrees inclusively, in another UHA1 is between 3 degrees and 25 degrees inclusively and, in another UHA1 is between 5 degrees and 15 degrees inclusively. Similarly, in one specific embodiment the second end 60 has an upward height angle UHA2 of between 3 degrees and 35 degrees inclusively, in another UHA2 is between 3 degrees and 25 degrees inclusively and, in another UHA2 is between 5 degrees and 15 degrees inclusively. It is contemplated to provide each end 58, 60 with the same height design (both with a UHA of between 3 degrees and 25 degrees, for example). It is also contemplated, however, for each end to have a different height design (one end may have a UHA of between 3 degrees and 35 degrees while the other end has a UHA of between 5 degrees and 15 degrees, for example). In yet another embodiment, shown, the entire mid-section 62 may have the same height H3 but it is also contemplated to provide the mid-section 62 with differing heights.

With reference now to FIG. 10, in one embodiment, the maximum extension amount E3 of the top portion of the mid-section 62 is significantly less than the extension amounts E1, E2 of the top portions of the first and second ends 58, 60, respectively. The amounts E1 and E2 may be the same, as shown, or in another embodiment the amounts E1, E2 may be different from each other. In yet another embodiment, the extension of the first end 58 of the snowplow surface 52 gradually increases outwardly from the extension amount E3 to the extension amount E1, as shown, and/or the extension of the second end 60 of the snowplow surface 52 gradually increases outwardly from the extension amount E3 to the extension amount E2, as shown. In one specific embodiment, the first end 58 has an outward extension angle OEA1 of between 5 degrees and 35 degrees inclusively, in another OEA1 is between 5 degrees and 25 degrees inclusively and, in another OEA1 is between 5 degrees and 15 degrees inclusively. Similarly, in one specific embodiment the second end 60 has an outward extension angle OEA2 of between 5 degrees and 35 degrees inclusively, in another OEA2 is between 5 degrees and 25 degrees inclusively and, in another OEA2 is between 5 degrees and 15 degrees inclusively. It is contemplated to provide each end 58, 60 with the same extension design (both with an OEA of between 5 degrees and 25 degrees, for example). It is also contemplated, however, for each end to have a different extension design (one end may have an OEA of between 5 degrees and 35 degrees while the other end has an OEA of between 5 degrees and 15 degrees, for example). In yet another embodiment, shown, the entire mid-section 62 may have the same extension amount E3 but it is also contemplated to provide the mid-section 62 with differing amounts of extension.

With reference now to FIGS. 1-10, in one embodiment, the snowplow blade 44 is substantially rigid, and thus does not naturally bend or flex. In another embodiment, the snowplow blade 44 is one-piece, and thus does not have separate wings as are known in the art. In yet another embodiment, shown in FIGS. 1 and 6, a horizontal line 70 extending from the first end 58 to the second end 60 between the bottom portion 54 and the top portion 56 continuously contacts the snowplow surface 52. As is known to those of skill in the art, a snowplow blade is positioned to engage snow at an attack angle AA, shown in FIG. 4, for purposes of plowing. While the snowplow blade 44 of this invention can have any attack angle AA chosen with the sound judgment of a person of skill in the art, in one embodiment the attack angle AA is between 50 degrees and 80 degrees inclusively. In a more specific embodiment, the attack angle AA is between 60 degrees and 70 degrees inclusively. In yet a more specific embodiment, the attack angle AA is about 65 degrees.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A snowplow comprising:

a snowplow blade that is suitable to be attached to an associated vehicle and that has a snowplow surface for use in contacting and plowing associated snow as the associated vehicle moves;

wherein the snowplow surface has: a bottom portion; a top portion; and, a C-shaped cross-section;

wherein the snowplow surface has: a first end; a second end; and, a mid-section;

wherein: the top portion of the first end has at least a first segment that extends forwardly a first amount E1; the top portion of the second end has at least a first segment that extends forwardly a second amount E2; and, the top portion of the mid-section extends forwardly a maximum third amount E3 that is significantly less than the first and second amounts E1 and E2; and, wherein a horizontal line extending from the first end to the second end between the bottom portion and the top portion continuously contacts the snowplow surface.

2. The snowplow of claim 1 wherein:

the bottom portion of the snowplow surface has a width W1; and, the top portion of the snowplow surface has a width W2 that is significantly greater than width W1.

3. The snowplow of claim 1 wherein:

the first end of the snowplow surface has a height H1;

the second end of the snowplow surface has a height H2; and, the mid-section of the snowplow surface has a height H3 that is significantly less than height H1 and height H2.

4. The snowplow of claim 2 wherein:

the width of the snowplow surface gradually increases from the bottom portion with the width W1 to the top portion with the width W2.

5. The snowplow of claim 4 wherein:

the first end has an upward width angle UWA of between 5 degrees and 15 degrees inclusively; and, the second end has an upward width angle UWA of between 5 degrees and 15 degrees inclusively.

6. The snowplow of claim 2 wherein:

the ratio of the width W1 to the width W2 is between 0.85 and 0.95 inclusively.

7. The snowplow of claim 3 wherein:

the height of the first end of the snowplow surface gradually increases outwardly from the height H3 to the height H1; and, the height of the second end of the snowplow surface gradually increases outwardly from the height H3 to the height H2.

8. The snowplow of claim 7 wherein:

the first end has an upward height angle UHA of between 3 degrees and 15 degrees inclusively; and, the second end has an upward height angle UHA of between 3 degrees and 15 degrees inclusively.

9. The snowplow of claim 7 wherein the entire mid-section has the height H3.

10. The snowplow of claim 1 wherein:

the extension of the first end of the snowplow surface gradually increases outwardly from the third extension amount E3 to the first extension amount E1; and, the extension of the second end of the snowplow surface gradually increases outwardly from the third extension amount E3 to the second extension amount E2.

11. The snowplow of claim 10 wherein:

the first end has an outward extension angle OEA of between 5 degrees and 25 degrees inclusively; and, the second end has an outward extension angle OEA of between 5 degrees and 25 degrees inclusively.

12. The snowplow of claim 10 wherein the entire mid-section has the extension amount E3.

13. The snowplow of claim 1 wherein the snowplow blade is substantially rigid.

14. The snowplow of claim 1 wherein the snowplow blade is one-piece.

15. A snowplow comprising:

a snowplow support frame that is suitable to be attached to an associated vehicle;

a snowplow blade that is suitable to be attached to the snowplow support frame and that has a snowplow surface for use in contacting and plowing associated snow as the associated vehicle moves;

wherein the snowplow surface has: a bottom portion with a width W1; a top portion with a width W2 that is significantly greater than width W1; and, a C-shaped cross-section;

wherein the snowplow surface has: a first end with a height H1; a second end with a height H2; and, a mid-section with a height H3 that is significantly less than height H1 and height H2;

wherein a horizontal line extending from the first end to the second end between the bottom portion and the top portion continuously contacts the snowplow surface; and, wherein: the top portion of the first end has at least a first segment that extends forwardly a first amount E1; the top portion of the second end has at least a first segment that extends forwardly a second amount E2; and, the top portion of the mid-section extends forwardly a maximum third amount E3 that is significantly less than the first and second amounts E1 and E2.

16. The snowplow of claim 15 wherein:

the snowplow blade is substantially rigid; and, the snowplow blade is one-piece.

17. The snowplow of claim 16 wherein:

the width of the snowplow surface gradually increases from the bottom portion with the width W1 to the top portion with the width W2;

the extension of the first end of the snowplow surface gradually increases outwardly from the third extension amount E3 to the first extension amount E1;

the extension of the second end of the snowplow surface gradually increases outwardly from the third extension amount E3 to the second extension amount E2;

the height of the first end of the snowplow surface gradually increases outwardly from the height H3 to the height H1; and, the height of the second end of the snowplow surface gradually increases outwardly from the height H3 to the height H2.

18. The snowplow of claim 17 wherein:

the first end has an upward width angle UWA of between 5 degrees and 15 degrees inclusively;

the second end has an upward width angle UWA of between 5 degrees and 15 degrees inclusively;

the first end has an upward height angle UHA of between 3 degrees and 15 degrees inclusively;

the second end has an upward height angle UHA of between 3 degrees and 15 degrees inclusively;

the first end has an outward extension angle OEA of between 5 degrees and 25 degrees inclusively; and, the second end has an outward extension angle OEA of between 5 degrees and 25 degrees inclusively.

19. The snowplow of claim 18 wherein:

the entire mid-section has the height H3;

the entire mid-section has the extension amount E3; and, the ratio of the width of the mid-section to the width W2 is between 0.24 and 0.60 inclusively.

20. The snowplow of claim 19 wherein:

the snowplow blade has an attack angle between 55 degrees and 75 degrees inclusively; and, the snowplow support frame is suitable to be attached an associated ATV.

* * * * *